US005696345A

United States Patent [19]

Nordelius

[11] Patent Number: 5,696,345

[45] Date of Patent: Dec. 9, 1997

[54] METHOD AND DEVICE FOR VARYING PITCH OF ELECTRONICALLY GENERATED TONES

[75] Inventor: Hans Nordelius, Stockholm, Sweden

[73] Assignee: Clavia Digital Musical Instruments, Stockholm, Sweden

[21] Appl. No.: 554,195

[22] Filed: Nov. 6, 1995

[30] Foreign Application Priority Data

Nov. 4, 1994 [SE] Sweden ..... 9403801

[51] Int. Cl.[6] ..... G10H 3/00

[52] U.S. Cl. ..... 84/723; 84/730; 84/745

[58] Field of Search ..... 84/600, 628, 623, 84/733, 734, 737, 739, 740, 743, 744, 704

[56] References Cited

U.S. PATENT DOCUMENTS

| | | | |
|---|---|---|---|
| 3,624,584 | 11/1971 | Ohno | 338/69 |
| 3,699,492 | 10/1972 | Yoshihara | 338/69 |
| 4,347,772 | 9/1982 | Nishimoto | 84/628 |
| 4,653,374 | 3/1987 | Iba | 84/628 X |
| 4,852,443 | 8/1989 | Duncan et al. | 200/600 X |
| 5,006,681 | 4/1991 | Postmus et al. . | |
| 5,099,742 | 3/1992 | Meno | 84/690 |
| 5,119,713 | 6/1992 | Usa et al. | 84/628 |
| 5,241,126 | 8/1993 | Usa et al. | 84/628 X |
| 5,401,898 | 3/1995 | Usa et al. . | |

FOREIGN PATENT DOCUMENTS

WO 88/10488
A1 12/1988 WIPO .

*Primary Examiner*—William M. Shoop, Jr.
*Assistant Examiner*—Jeffrey W. Donels
*Attorney, Agent, or Firm*—Dergosits & Noah LLP

[57] ABSTRACT

A device (1) for varying pitch manually on electronic keyboard instruments having electronically generated tones is made as a stick or rod. The upper portion of the stick is also the upper part of handle (5) which extends upwards, through a window (11) above the top surface of a casing (13) of the instrument. The handle (5) is attached to an elastic leaf spring (3), the bending of which is sensed by means of strain gauges (21) mounted on the plate (3) at the lower portion thereof, adjacent the attachment region thereof to a rigid cantilever (19). When the handle (5) is moved by means of a finger in its cup-shaped, top surface, the leaf spring (3) is deflected, the deflection signal being provided to the electronic circuits that generate the tones and that then give them a higher or lower pitch depending on the deflection. Such a pitch stick (1) does not contain a "dead" region at its rest position or non-influenced position, it does not require initially, when it is acted on for a displacement away from its rest position, an initial force and it has a simple and durable construction.

15 Claims, 5 Drawing Sheets

METHOD AND DEVICE FOR VARYING PITCH OF ELECTRONICALLY GENERATED TONES

TECHNICAL FIELD

The present invention relates to methods and devices for varying pitch of electronically generated tones, in particular to be used together with a keyboard for playing music.

BACKGROUND

In music generated by synthesizers, that is generally music which is generated electronically by means of tone synthesis and for which chosen tone pitches and other qualities of tones are controlled by depressing various keys on a keyboard, a need exists for creating vibratos and other deviations from a given tone pitch in the same way as for acoustic or semi-acoustic instruments of type guitars. It is conventionally made in synthesizers by the method that the music player operates manually a wheel or pulley, that protrudes partly out of a surface adjacent or in the keyboard. This wheel is coupled to a potentiometer having its resistor element made of coal such as graphite, the resistance of which varies when the wheel is rotated, that is when that edge of the wheeel that is directed upwards is manually operated. The wheel is spring-biassed to a adopt zero position, where no special effect is produced on the tone or tones being generated at the considered time, this tone or tones being activated by a depression of one or several keys on the keyboard. When the wheel is operated or rotated in one direction the pitch is increased and for an operation in the opposite direction the pitch is lowered.

Owing to the inherent friction in the potentiometer coupled to the wheel always a hysteresis is obtained in the zero position of the wheel, so that when the wheel is not manually influenced, it will certainly tend to return, by being biassed by a suitably arranged spring, to the zero position, but the wheel will normally stop some distance before it has reached exactly the zero position. If the potentiometer used then would be the common linear type, this effect would of course be manifest in that, also in the case where the wheel is released and is not held or operated, a displacement of the pitch from the nominal pitch is obtained, which nominal pitch is to be produced for a depression of a key on the keyboard. The hysteresis must be compensated by using potentiometers or potentiometer circuits, which present a constant resistance for small rotations from the zero position of the wheel. This compensation can also be made electronically. Such a construction will however make the whole device less sensitive to the manual movements of the player and relatively large rotations of the pitch wheel are required for generating vibratos and similar effects. For vibratos, when rotations of the wheel in alternating directions are required, then also an indifferent or unsensitive region about the zero position is obtained, which can be quite embarrassing. In making vibratos on acoustic music instruments generally no such unsenzitive region exists, nor the mechanical resistance against a rotation from a zero position, which appears in normal constructions in a wheel that is spring-loaded to a predetermined position.

In U.S. Pat. No. 5,099,742 an apparatus is disclosed for altering the output of a string of an electronic string musical instrument, responding to bending of the string and causing then a frequency variation of the output tone.

The published International patent application WO-A1 88/10488 discloses an auxiliary device for a music synthesizer having slidable bars, intended to be operated by a portion of the arm/hand of a player and then causing for example a pitch variation. The sliding motion is always accompanied by some friction causing the same disadvantage as discussed above.

U.S. Pat. Nos. 3,699,492 and 3,624,584 disclose devices for generating a portamento effects on an electronic musical instrument comprising variable resistance, elastic elements.

SUMMARY

It is an object of the invention to provide a device for varying tone pitch that creates directly, for a manual activation from a zero position, a variation of the pitch.

It is a further object of the invention to provide a device for varying tone pitch, which does not initially present a mechanical resistance when it is displaced, for varying the pitch, from a zero position or is acted on to deviate from a zero position.

It is a further object of the invention to provide a device for varying tone pitch, which provides a tactile feedback or sensation in the use thereof, that is analogous or similar to that obtained for string instruments.

It is a further object of the invention to provide a device for varying tone pitch, which has a compact, durable and simple mechanical construction.

These objects are achieved by the invention, the features and characteristics of which appear from the description and the appended claims.

The device for varying pitch manually is thus designed as a stick or rod, the upper portion of which extends upwards, through a window in a casing of an electronic musical instrument. The upper portion is mounted to an elastic body in the shape of a resilient strip or plate, the bending of which is sensed in a suitable way, such as by means of strain gauges mounted on the strip or plate. Other sensors, for instance optical ones, can also be used. The plate is at its other, lower end rigidly attached to some frame part or casing belonging to the instrument. When the upper portion is moved by means of a finger placed on its top surface, the elastic body is deformed, that is the leaf spring or plate is bent. The deflection signal from the sensor or sensors is provided to the electronic circuits that generate the tones. Then they produce a higher or lower pitch of the generated tones depending on the magnitude and the direction of the deflection.

A variation or modification of the pitch of an electronically generated tone, which has a fixedly set ground frequency, that is obtained when a key on keyboard is depressed, is thus generally made by deforming an elastic body, typically a resilient rod or plate, by manual influence such as by being for example bent or rotated by means of a finger or another part of the body of the person playing music. It can also be described such as that a part of the elastic body is displaced or moved in relation to another part of the elastic body, which is then fixedly mounted. The deformation of the elastic body is measured and converted to an electric signal by means of some suitable sensor such as a strain gauge, generally a detector recording the deformation without interfering with the movement or rendering it more difficult or at least not disturbing the continuous movement thereof. Contactless movement sensors can thus be used, such as optical sensors. The sensor should not in any case put an initial force on the elastic body for deforming it from a start position, that is the body must not be subjected to a force of any magnitude for being displaced or deformed at all from the start position. A strain gauge adhesively bonded to a steel plate strip can however give the strip a somewhat increased stiffness, but the increased force required for bending the strip is then still proportional to the deflection without causing any such initial force.

The electronically generated tone having a predetermined pitch is then modified as indicated by the electric signal, for instance proportionally to the deviation thereof from the base value of the signal. In the case where a deformation of the elastic body exists, the tone pitch is increased or reduced depending pending the magnitude and direction of the deformation. The dependence of the electric signal can in addition be made in different ways. An advantageous embodiment is that the resulting deviation of the tone pitch is essentially linearly dependent on or substantially proportional to the deviation of the deformation from a start position of the elastic body and that the deviation comprises a superlinear dependence for large deviations, so that when the body is deformed in one first direction, first the increase of the pitch is essentially proportional to the deformation but for larger deformations the increase is more than linear, and the corresponding process for a deformation in a second, opposite direction, so that then the tone pitch decreases first essentially proportionally to the deformation from the start position, comprising a more than linear decrease for a larger deformation in this second direction.

The start position of the deformation of the elastic body is advantageously a rest or idling position, in which the elastic body is relaxed and is not subjected to exterior forces, from other mechanical devices, that is it is not actively urged to this position by other devices. Thereby the desired effect is achieved, that no initial force is required for starting the deformation, in particular the deflection or bending, of the elastic body. It gives a tactile sensation to the music player or the operator, which resembles that which can be obtained when the corresponding musical effects are produced on a string instrument like a guitar. No initial resistance exists when the operation is started. Providing a proportionally increasing force that has to be used for increasing deviations from the start position, also a tactile feedback to the operator or feedback relating to his sense of touch is obtained, so that the increasing resistance from the device can be converted directly, in his nervous system, to a desired tone pitch deviation, in addition to the sound effect which is of course also experienced by the operator.

The elastic body can, as has been mentioned, advantageously comprise an element having the shape of a strip, plate or disc, in particular an elongated, resilient bar or stick that is subjected to a deflection when it is acted on manually.

In the case, where strain gauges are used, it can be generally described such as that the deformation is measured by means of an electrical circuit comprising a resistor mounted at the elastic body, the resistance of which varies when it is deformed. The elastic body is normally arranged, so that one part thereof is rigidly secured to some casing or frame part or some base plate of the device, and then it can be suitable to place the sensor or resistor on the elastic body, so that its electrical terminals are located near or on the fixedly attached pert. Such an arrangement results in that the electrical coupling wires to the sensor can be arranged substantially stationarily, what reduces the risk of ruptures of the wires.

DESCRIPTION OF THE DRAWINGS

The invention will now be described by way of non limiting, specific embodiments with reference to the accompanying drawings, in which.

DETAILED DESCRIPTION

Figure 2:
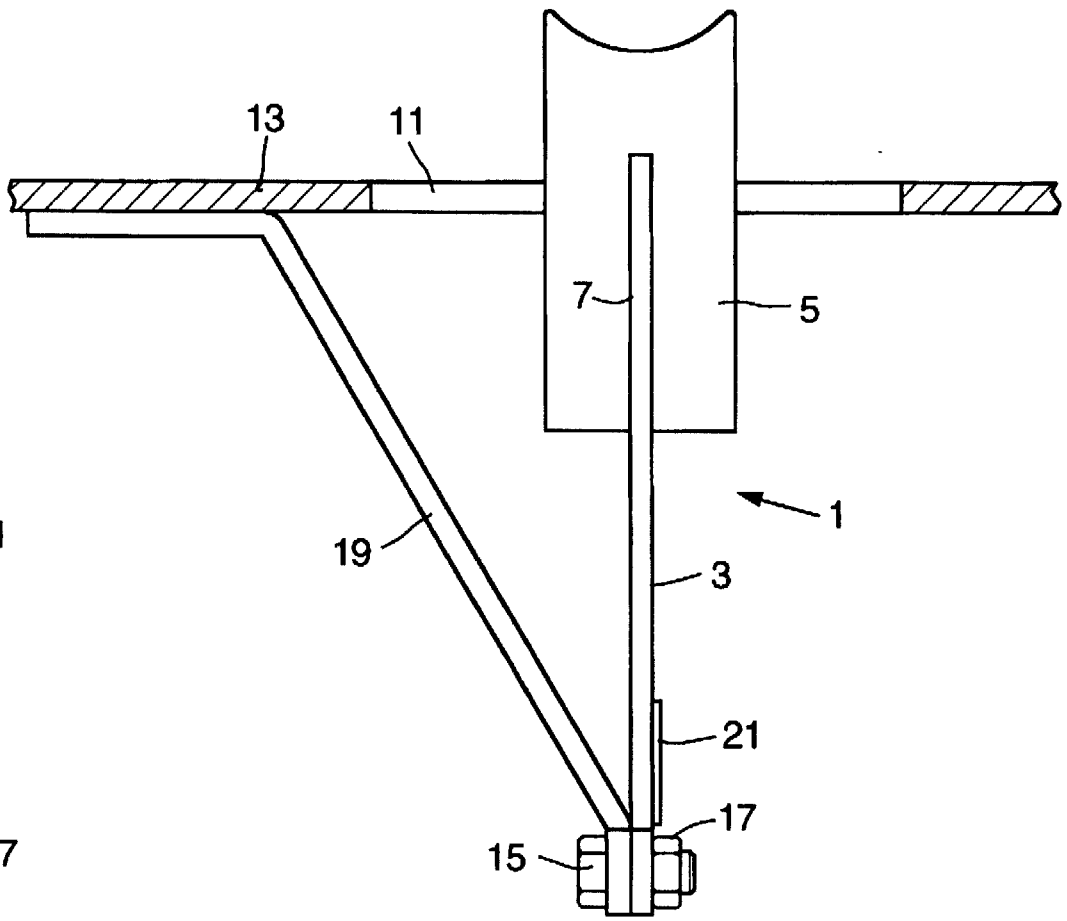
FIG. 2 is another side view of the device of FIG. 1 as seen perpendicularly to the movement direction of the device.
Figure 1:
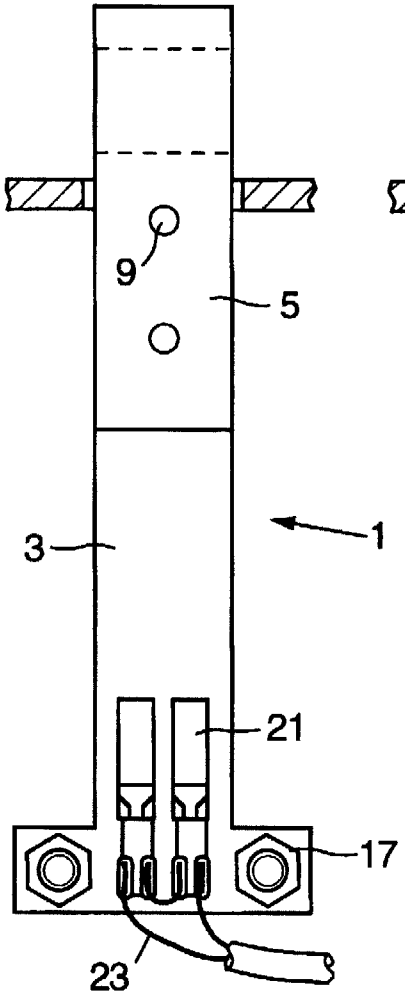
FIG. 1 is a side view of a device for varying pitch as seen in the movement direction of the device.

The device for varying tone pitch, as illustrated in FIGS. 1 and 2 in two perpendicular elevational views, comprises a metal strip or plate 3 made of spring steel. The spring 3 has a generally elongated body comprising protruding parts at the lower end thereof, so that it has a T-shape in the embodiment shown. A handle 5 is secured to the upper end of the leaf spring 3, the handle having the shape of a generally rectangular wood piece comprising a slot 7, so that the upper end of the spring 3 passes into the slot 7. The slot extends from the lower end of the handle 5 and rivets 9 extend through holes in the handle 5 and the leaf spring 3 for securing them to each other. The top portion of the handle 5 has a concave cup-shape and extends, through a window 11, upwards, above the upper plate 3 of a keyboard, see also the schematic perspective view of FIG. 4.

In the protruding parts at the lower end of the leaf spring 3 holes are provided, through which screws 17 provided with nuts 15 pass, for securing the plate 3 to a cantilever 19, which at its lower end has corresponding holes. The cantilever 19 is made of bent, rigid, sheet iron of a larger thickness than the leaf spring 3 and its lower and upper end regions are located perpendicularly to each other, the intermediate region of the cantilever being located in an oblique angle in relation to the end regions. The upper end region is secured to the underside of the keyboard plate 13, for instance by means of spot welding.

At the lower end of the body of the leaf spring 3, somewhat above the protruding parts, two strain gauges 21, that are connected in series with each other, are adhesively bonded at the same height or level. The outer terminals, that are not connected to each other, of the gauges 21 are connected to electrical conductor leads 23. When the upper part of the handle 5 is manually operated by the method that a person places a finger in the cup-shaped top surface and moves it forwards and backwards, reciprocatingly, the handle 5 is moved forwards and backwards in the window 11 and the leaf spring 3 is bent, the cantilever 19 being not significantly affected. The bending of the leaf spring 3 produces a varying resistance of the strain gauges 21, that is detected by means of suitable electric circuits coupled to the electrical conductors 23.

Due to the fact that the strain gauges 21 are placed at the lower end of the body of the leaf plate 3, a little above the region where it is attached to the cantilever 19, the connections of the strain gauges 21 can be placed precisely at the area of the leaf spring 3, in which it is secured to the cantilever and which does not move significantly when the handle 5 is moved and the leaf, spring is bent. It causes that the terminals connected to the electrical conducting wires 23 do not move either, so that they can all the time be located in the same position, what reduces the risk of interruptions of the conductor wires 23. Preferred dimensions may be that the leaf spring 3 has a length of a little more than 50 mm, a width of 10 mm and a thickness of 0.7–0.8 mm. The strain gauges 21 can have their lower edges placed a few mm above the upper edge of the lower, protruding pans of the leaf spring 3, e.g. 3–4 mm above the upper edge of the attachment region of the leaf spring 3. The cantilever 19 can have the same width as the leaf spring and can be made of sheet iron having twice the thickness of the spring, such as a thickness of 1.5–2 mm.

Figure 3:
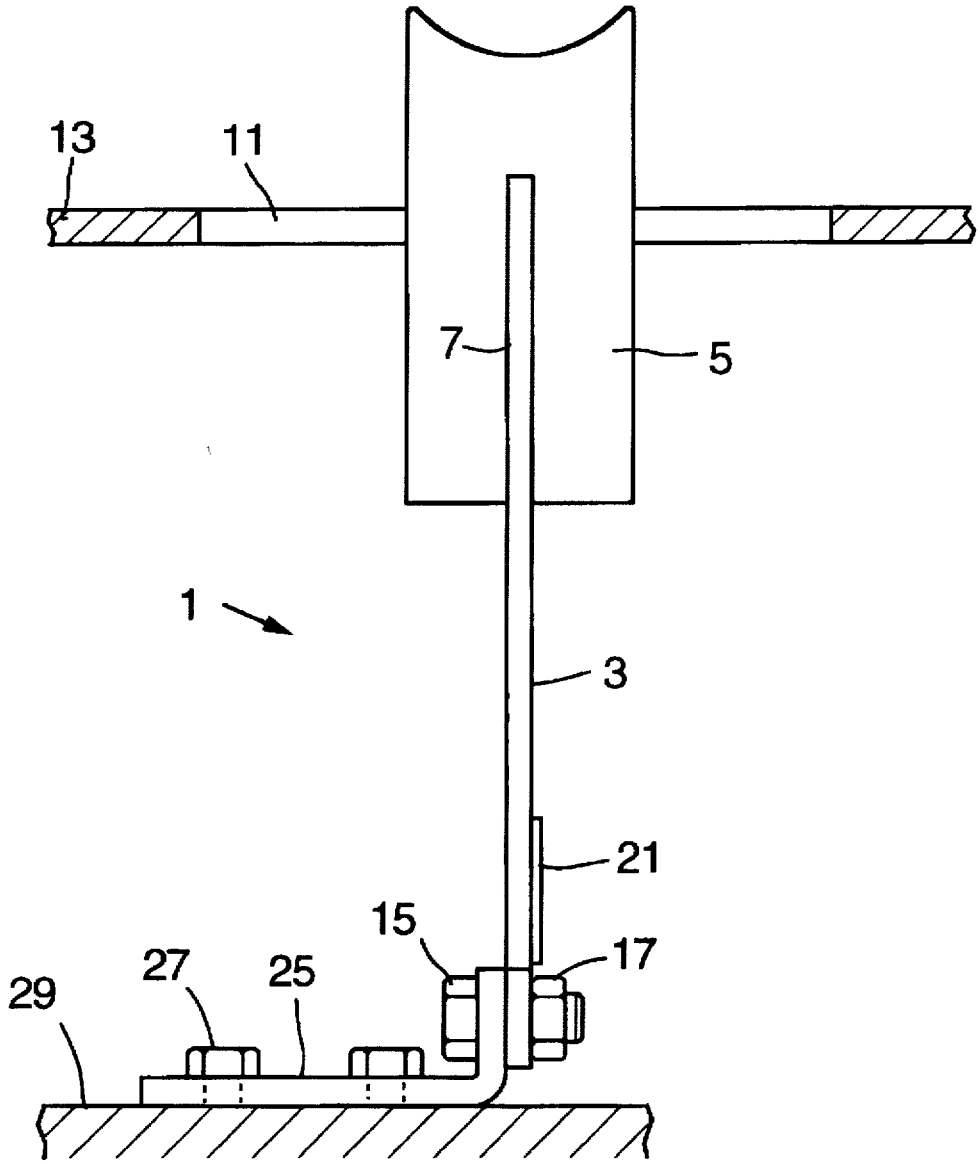
FIG. 3 is a view similar to that of FIG. 2 where the device of FIG. 1 is attached in an alternative manner.

An alternative attachment method of the leaf spring 3 is illustrated in the elevational view of FIG. 3. Here, instead of the cantilever 19 a strong, bent iron knee 25 is provided, one leg of which is attached, by means of screws 15 passing through holes in the knee leg and through the corresponding holes in the protruding parts at the lower end of the leaf spring 3, to the leaf spring 3. Its other leg is provided with suitable holes, through which screws 27 extend into a base element 29, e.g. a bottom plate of the keyboard. The knee part 25 has so large dimensions, that when the device 1 is activated by operating the handle 5, the knee part will remain essentially unaffected.

Figure 4:
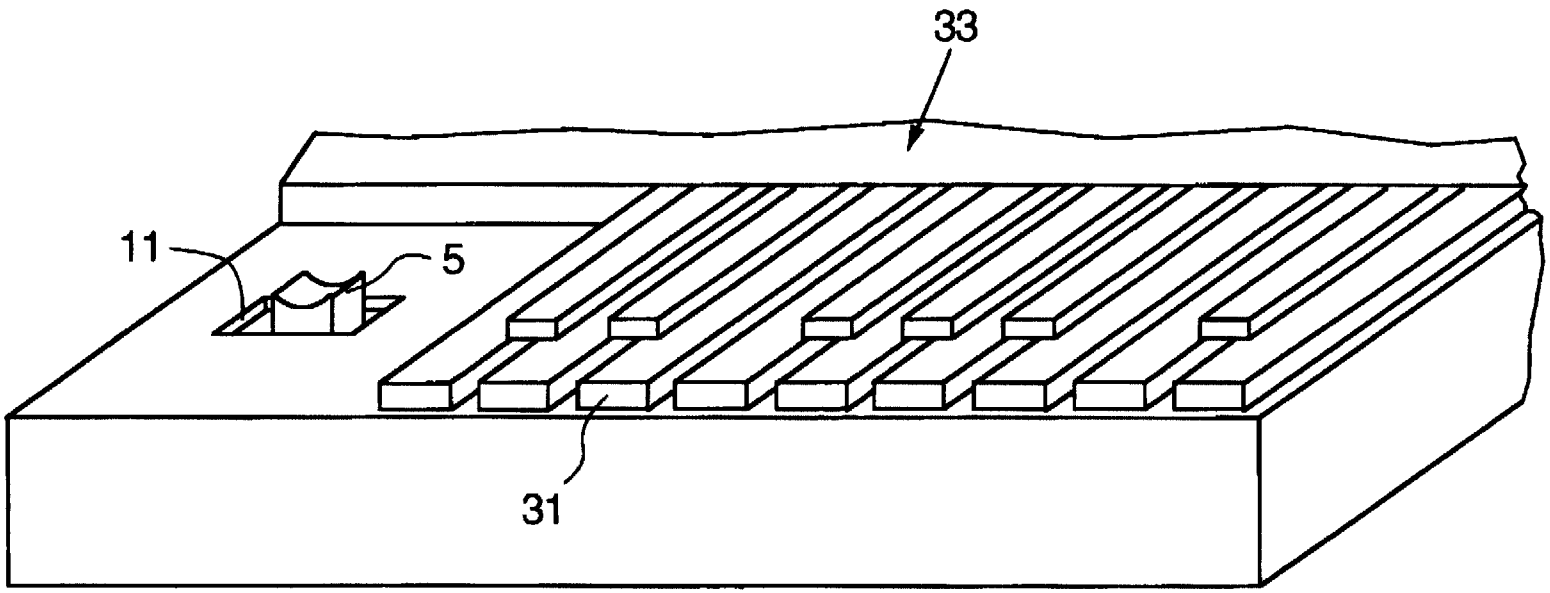
FIG. 4 is a partial, schematic perspective view of an electronic keyboard instrument.
Figure 5:
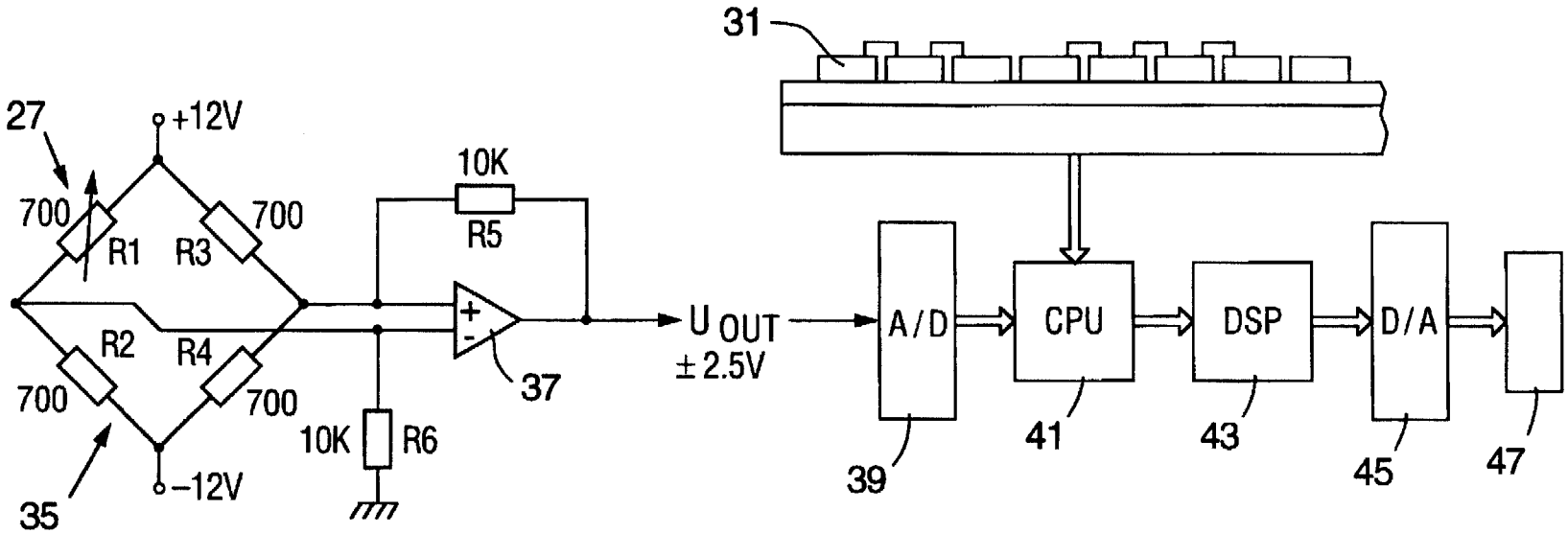
FIG. 5 is a diagram of an electrical circuit to be used by the device of FIG. 1, partly in the shape of blocks.

In the perspective view of FIG. 4 it is illustrated how the top portion of the handle 5 extends upwards through the window 11 in the keyboard plate, which window is made at the side of or at a place in the longitudinal direction as considered from the row of keys 31 in a set 33 of keys. In the same area, where the window 11 is made, normally other special control devices or adjustment devices for special functions are located.

The resistance of the strain gauges 21, that reflects the varying bending of the leaf spring 3, is detected by means of a conventional measurement bridge 35, comprising four resisters $R_1$, $R_2$, $R_3$ and $R_4$. Thereamong, the resistor $R_4$ corresponds to the strain gauges 21, which, in the circuit shown, can be assumed to have typically the resistance, of 700 ohms in a rest or idling position when the leaf spring adopts it non-operated or relaxed state. The other resisters $R_2$, $R_3$ and $R_4$ have the same resistance value as the idling resistance value of $R_1$. Two opposite terminal points of the bridge 35 are connected to a suitable voltage source, in the embodiment shown to +12 V and −12 V. The bridge is balanced by the method that one of the other resistors $R_2$, $R_3$ and $R_4$ has an adjustable resistance, that is adjusted, so that for the leaf spring 3 in a rest position no voltage is obtained between the other two opposite junctions of the bridge 35. These two other junction points are coupled to the input terminals of an amplifier 37, for example an operational amplifier, that is connected, by means of a feedback resistor $R_5$ connected between the output terminal and an input terminal, to give a suitable gain. In the case shown $R_5$ is chosen to be 10 kohms what gives an output signal between −2.5 V and 2.5 V for the possible variations of the resistance $R_1$. The input terminal of the amplifier 37, to which the feedback resistor $R_5$ is not connected, is through a resistor $R_6$ having the resistance 10 kohms connected to ground.

The output signal of the amplifier 37 is feed to an analog-to-digital converter 39, in which the signal is converted to a digital form for being provided therefrom to a processor 41. The processor 41 receives also signals from the keys 31 in the keyset 33 and these signals indicate in some suitable way those keys which are depressed at the current time. The processor 41 processes the received signals and transmits commands in respect of chosen frequencies to a digital signal processor 43. The signal processor 43 generates suitable digital tone signals having the chosen frequencies, which are provided to a digital-to-analog converter 45, that converts the signals to an analog form and delivers them to a loudspeaker 47.

Figure 6:
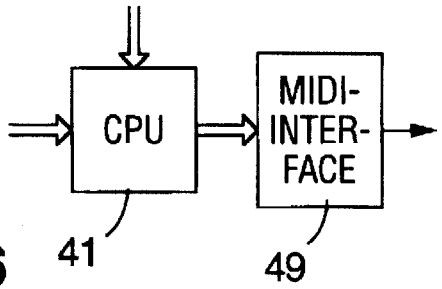
FIG. 6 is a diagram of an alternative embodiment of the final stage of the circuit of FIG. 5 for connection to a MIDI-interface.

Alternatively, as is illustrated schematically in FIG. 6, the processor 41 can generate signals, which are suitable for being provided to a MIDI-interface 49. The signals comprise in this case information on those tempered pitches which are to exist at the present time and on possible deviations therefrom, as obtained from the measurement bridge 35. The output signal of the MIDI-interface can therefrom be delivered to a suitable electronic device, such as other electronic musical instruments, a personal computer equipped with a sound board, etc.

Figures 7, 8:
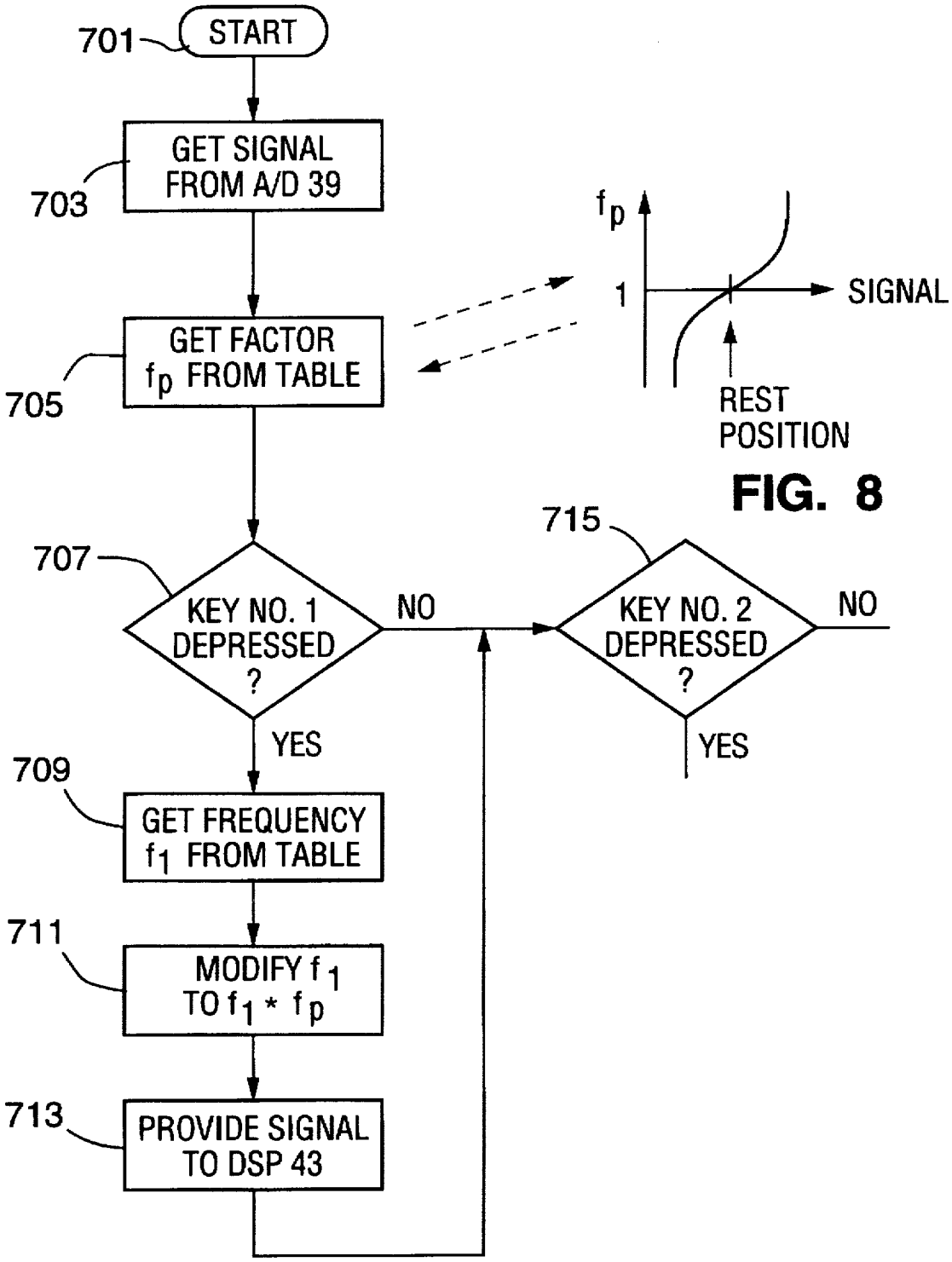
FIG. 7 is a simplified flow diagram of the operational steps of a processor in the instrument.
FIG. 8 is a diagram of modifying factors as a function of a deviation signal.

In FIG. 7 a flow diagram is illustrated of the procedural steps that can be executed by the processor 41. The procedural steps start in a start block 701, whereupon in a block 703 information is retrieved from the analog-to-digital converter 39 in the form of a digital value. This digital value is converted to a suitable factor $f_p$ in a block 705 by a table-lookup in a table of values stored in a memory in the processor 41. The mathematical function which is then used for the factor as dependent on the electrical deviation signal can for instance have the shape as illustrated in the diagram of FIG. 8. About the rest position, that is the value of the A/D-converter 39, which corresponds to the condition that the leaf spring 3 is not operated, the factor $f_p$ is here a substantially linear, increasing function of the input signal having a value equal to 1 for the rest value of the input signal. For large deviations from the rest position the function can decrease or increase respectively more rapidly than linearly.

When the factor $f_p$ has been determined, it is decided in a block 707, whether a first one, No. 1, of the keys is depressed, where the keys are numbered in some suitable order. If it is decided that this key is depressed, in a block 709 a frequency value is taken for this key in a table stored in a memory in the processor 41. In a block 711 the frequency value $f_1$ is modified by being multiplied with the factor $f_p$ and the result is provided to the signal processor 43 in a block 713. Thereupon it is tested in the same way as in the block 707 whether the next key No. 2 is depressed in a block 715, whereupon the corresponding steps are executed for this key, etc. This test in the block 715 is also executed directly in the case where it is decided in the block 707, that the key No. 1 is not depressed. The procedure is repeated for all remaining keys 31 in the corresponding way. Thereafter, the whole procedure is terminated. After a possible delay the procedure is restarted, in the start block 701, so that the whole procedure is run through at a frequency of typically 8 kHz.

What is claimed is:

1. A method of producing tones having varying pitches, comprising the steps of:

providing a device comprising an electronic keyboard having at least one key, an electronic means, an elastic body, a sensor and a pitch modulating means;

depressing at least one key of the electronic keyboard;

producing in response to the depressing of the at least one key, an electronically generated tone having a fixed frequency and a predetermined pitch;

deforming the elastic body;

measuring the deformation of the elastic body with the sensor and converting the measured deformation to an electrical signal; and modifying the electronically generated tone so that the tone's pitch is modified depending on the electrical signal.

2. The method as claimed in claim 1, wherein the deformation of the elastic body is accomplished from a rest position.

3. The method as claimed in claim 1, wherein the deformation is measured, so that the electrical signal is proportional to the deformation of the elastic body from the rest position.

4. The method as claimed in claim 1, wherein the deformation is measured using a sensor comprising a resistor attached to the elastic body, wherein the resistance varies according to the deformation of the elastic body.

5. A method of producing tones having varying pitches, comprising the steps of:

providing a device comprising an electronic keyboard having at least one key, an electronic means, an elastic body, a sensor and a pitch modulating means;

depressing at least one key of the keyboard;

producing in response to the depressing of the at least one key, at least one electronically generated tone having a fixed frequency and a predetermined pitch;

displacing the elastic body;

measuring the displacement of the elastic body with the sensor from a relaxed position and converting the measured displacement to an electrical signal;

modifying the one or more electronically generated tones depending on the electrical signal; and providing the elastic body with an accurately determined relaxed position, wherein each predetermined pitch remains constant when the elastic body is in the relaxed position and further wherein each pitch is varied linearly depending on the measured displacement of the elastic body from the relaxed position.

6. The method as claimed in claim 5, wherein the measurement and conversion of the displacement of the elastic body is performed, so that the electrical signal is linearly dependent on the displacement of the elastic body from the relaxed position.

7. A method of producing tones having varying pitches, comprising the steps of:

providing a device comprising an electronic keyboard having at least one key, an electronic means, an elastic body, a sensor and a pitch modulating means;

depressing at least one key of the keyboard;

producing in response to the depressing of the at least one key, an electronically generated tone having a fixed frequency and a predetermined pitch;

displacing the elastic body;

measuring the displacement of the elastic body from a relaxed position and converting the measured displacement of the elastic body to an electrical signal;

modifying the electronically generated tone depending on the electrical signal; and configuring the elastic body in the relaxed position wherein no force is required, to maintain the elastic body in the relaxed position, and further wherein applied force will displace the body.

8. The method as claimed in claim 7, wherein the elastic body is configured, so that the applied force is proportional to the displacement of the body from the start position, at least for small displacements from the start position.

9. A device for producing tones having varying pitches, comprising:

a keyboard having at least one key;

electronic means for generating electronically, in response to a depressing of the at least one key, a tone having a predetermined pitch;

an elastic body having an elongated plate and a leaf spring;

a sensor arranged to provide an electrical signal dependent on a deformation of the elastic body; and pitch modulating means for varying the tone's pitch, depending on the electrical signal, the tone's pitch, generated by the sensor.

10. The device as claimed in claim 9, wherein the sensor is arranged to sense the deformation of the elongated plate.

11. The device as claimed in claim 9 wherein the sensor comprises an electrical resistor, wherein the resistance varies according to the deformation of the elastic body.

12. A device for producing tones having varying pitches, comprising:

a keyboard having at least one key;

electronic means for generating electronically, in response to the depressing of the at least one key, a tone having a predetermined pitch;

an elastic body arranged to be available for being depressed;

means for measuring the displacement of the elastic body from a relaxed position and for converting the measured displacement to an electrical signal;

modifying means connected to the electronic means for modifying the tone having a predetermined pitch depending on the electrical signal generated by the measuring means, wherein the elastic body is so arranged, that it will adopt, when it is not acted on an accurately determined relaxed position, and the means for measuring and the modifying means are arranged to vary the predetermined pitch wherein the pitch varies linearly depending on the measured displacement of the elastic body, at least for small displacements from the relaxed position.

13. The device as claimed in claim 12, wherein the measurement and converting means are arranged, so that the electric signal provided by them is linearly dependent on the displacement of the elastic body at least for small displacements from the relaxed position.

14. A device for producing tones having varying pitches, comprising:

a keyboard having at least one key;

electronic means for generating electronically, in response to the depressing of the at least one key, a tone having a predetermined pitch;

an elastic body arranged to be available for being displaced;

means for measuring the displacement of the elastic body from a relaxed position thereof and for converting the measured displacement to an electrical signal; and, modifying means connected to the electronic tone generating means for modifying the tone having a predetermined tone pitch depending on the electrical signal generated in response to the measured, deformation of the elastic body, wherein the elastic body is so arranged, that it will adopt, when it is not acted on an accurately determined relaxed position, and the means for measuring and the modifying means are arranged to vary the predetermined pitch wherein the pitch varies linearly depending on the measured displacement, at least for small displacements from the relaxed position.

15. The device as claimed in claim 14, wherein the elastic body is biased to the relaxed position in such a way, that the force for displacing the elastic body is proportional to the displacement from the relaxed position, at least for small displacements from the relaxed position.

* * * * *